US006373191B1

(12) United States Patent
Jang et al.

(10) Patent No.: US 6,373,191 B1
(45) Date of Patent: Apr. 16, 2002

(54) BACKPLATE OF PLASMA DISPLAY PANEL

(75) Inventors: Woo-Sung Jang, Seoul; Je-Seok Kim, Ahnyang, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/451,838

(22) Filed: Dec. 1, 1999

(30) Foreign Application Priority Data

Dec. 2, 1998 (KR) ..... 98-52577

(51) Int. Cl.[7] ..... H01J 17/49
(52) U.S. Cl. ..... 313/582; 313/586; 313/587
(58) Field of Search ..... 313/582, 586, 313/587; 345/41, 60

(56) References Cited

U.S. PATENT DOCUMENTS 5,825,128 A * 10/1998 Betsui et al. ..... 313/586 X
5,972,528 A * 10/1999 Kim ..... 313/585 X
5,998,047 A * 12/1999 Bechtel et al. ..... 313/585 X
6,140,768 A * 10/2000 Kim ..... 313/585 X

FOREIGN PATENT DOCUMENTS

JP 07-094128 4/1995
JP 09-283033 10/1997
JP 09-330793 12/1997

* cited by examiner

*Primary Examiner*—Ashok Patel
(74) *Attorney, Agent, or Firm*—Fleshner & Kim, LLP

(57) ABSTRACT

The present invention discloses a structure of a PDP backplate and a fabrication method thereof which are capable of implementing a PDP having a high definition, high aspect ration and high luminance. The structure of a PDP backplate according to the present invention includes a metallic plate having a certain thickness, a plurality of barrier ribs arranged at a certain distance from each other on the metallic plate, an insulation layer formed on the wall surfaces of the barrier ribs and an upper surface of the metallic plate, a conductive layer formed on an upper surface of the insulation layer, a dielectric layer formed on a surface of the conductive layer, and a florescent layer formed on an upper surface of the dielectric layer.

20 Claims, 4 Drawing Sheets

BACKPLATE OF PLASMA DISPLAY PANEL

BACKGROUND OF THE INVENTION

1. Field of the Invention

The present invention relates to a flat panel display apparatus, and in particular to a backplate of a PDP(Plasma Display Panel) has a high definition, a high aspect ratio, and a high luminance.

2. Description of the Background Art

Recently, a flat panel display apparatus such as a LCD (Liquid, Crystal Display), a FED(Field Emission Display) and a PDP(Plasma Display Panel) has been intensively studied. Among the above-described apparatuses, the PDP is easily fabricated because of its simple structure and has a high luminance and light emitting efficiency, a good memory function, and a wide view angle wider than 160°, so that the PDP is well applicable to a wide screen of more than 40 inches.

The construction of a surface discharge AC PDP of the conventional art will be explained with reference to FIG. 1.

A front glass plate 10 and a back glass plate 20 are facing and distanced from each other, and a discharge region 30 which is defined by a corresponding barrier rib 23 is formed between the front glass plate 10 and the back glass plate 20.

A plurality of address electrodes A are extended in a certain direction on the upper surface of the back glass plate 20. A dielectric layer 22 is formed on the upper surfaces of the back glass plate 20 and the address electrodes A.

A plurality of barrier ribs 23 are formed on the upper surface of the dielectric layer between the address electrodes A. In addition, a fluorescent layer 24 is coated on both walls of each barrier rib 23 and on the upper surface of the dielectric layer 22 which covers the address electrodes A.

A sustain and display electrode Xn and a scan electrode Yn are spaced-apart in a parallel direction perpendicular to the direction of the address electrodes A on one surface of the front glass plate. The sustain and display electrode Xn is formed of a transparent ITO(lndium Tin Oxide), so that light passes through the same. Therefore, the sustain and display electrode is called as a transparent electrode. Bus electrodes 13 are formed at the end portions of the sustain and display electrode Xn and the scan electrode Yn for applying a stable driving voltage. The bus electrode 13 is formed of an aluminum or chrome/copper/chrome layers. In addition, a dielectric layer 14 which is formed of a PbO group material covers the sustain and display electrode Xn, the scan electrode Yn, the bus electrode 13 and the front glass plate 10. MgO is coated on the surface of the dielectric layer 14 as a protection film 15. The MgO protection film protects the PbO dielectric layer from a sputtering of ions and has a relatively higher secondary electron generating coefficient characteristic when an ion energy collides with the surfaces during a PDP plasma discharge and decreases a driving and sustaining voltage of the discharge plasma.

As shown in FIG. 1, He, Ne, Ar or a mixed gas of the same and a mixed gas of Xe 31 are filled in a discharge cell surrounded by the barrier rib of the PDP. The region between the barrier ribs becomes a discharge region 30, namely, a discharge cell 30 for generating a discharge therein.

In the PDP, a plasma discharge is generated in the discharge region 30 by applying a certain voltage to the transparent electrodes. As an infrared ray generated by the plasma discharge excites the fluorescent layer formed on the backplate for thereby generating a visual ray. The thusly generated visual ray is made incident onto the front plate for thereby displaying a certain character or graphic. Therefore, the front plate is used as a plate for displaying graphics, and the backplate is used for generating visual light.

As described above, the PDP apparatus includes a plurality of discharge cells which are physically separated from each other by the barrier ribs. In order to fabricate a PDP apparatus having a lot amount of pixels using the same area panel, a plurality of discharge cells are required. However, when decreasing the size of the discharge region in order to increase the number of discharge cells, the discharge efficiency is decreased. Therefore, in a state that a certain size of the discharge region is maintained, in order to manufacture a large number of discharge cells, a higher and thicker barrier rib is required. A method for satisfying the above-described requirements has been intensively studied. The conventional barrier rib fabrication method will be explained with reference to FIGS. 2 through 4.

First, a fabrication method of a barrier rib based on a screen print method will be explained with reference to FIGS. 2A through 2C.

As shown in FIG. 2A, a dielectric film 201 is formed on an upper surface of a glass plate 200. Next, a screen(not shown) having a pattern for fabricating a barrier rib is prepared on an upper surface of the glass plate 200. An insulation paste is coated on the screen using a roller, etc. and is dried for thereby forming a first insulation paste pattern 202 as shown in FIG. 2*a*. Thereafter, the screen is prepared thereon again, and an insulation paste is coated and then dried. The above-described operation is repeatedly performed, so that a second insulation paste pattern 203 is stacked on the first insulation paste pattern 202 as shown in FIG. 2*b*.

Next, the screen print method is repeatedly performed until the entire height of the stacked insulation paste pattern becomes 150~200 $\mu$m for thereby forming a barrier rib 204 as shown in FIG. 2C.

The above-described barrier rib fabrication method based on the screen print method is simple, and the cost of the same is low. However, it is needed to adjust the position of the plate and the screen at every time when performing the screen print process. In addition, a certain small misalignment may occur when adjusting the positions of the screen and plate in the repeated screen print processes, it is difficult to fabricate an accurate barrier rib and high definition barrier rib. In addition, since the above-described print and dry processes are repeatedly performed, a fabrication time is too extended.

As another conventional barrier rib fabricating method, there is a sand blasting method. The above-described sand blasting method will be explained with reference to FIGS. 3A through 3E.

Next, as shown in FIG. 3A, an insulation paste 301 is formed on a glass plate 200 by a thickness of 150~200 $\mu$m.

Next, as shown in FIG. 3B, a photosensitive film 302 is formed on the insulation paste 301. The photosensitive film 302 is formed in a tape shape by adding an organic material to a photosensitive slurry at a certain ratio and is stack-formed on the insulation paste.

The photosensitive film 302 is patterned by a photolithography method for thereby forming a photosensitive film pattern 302*a* as shown in FIG. 3C.

As shown in FIG. 3D, the insulation paste 301 is etched by spraying an alumina or silica particle(polishing material) using the photosensitive film pattern 302*a* as a mask.

Thereafter, the photosensitive film pattern 302a is removed for thereby forming a barrier rib 301*a* as shown in FIG. 3E.

In the barrier rib fabrication method based on the sand blasting method, it is possible to form a barrier rib on a large area plate and to implement a high definition. However, since a lot amount of pastes which are removed by a polishing material is required, and the fabrication cost is high. In addition, since a physical impact is applied to the plate during the fabrication process, a crack may occur at the plate during the molding operation of the insulation paste.

As another conventional barrier rib manufacturing method, an additive method will be explained with reference to FIGS. 4A through 4E.

As shown in FIG. 4*a*, a photosensitive film 401 is formed on a glass plate 400. The above-described photosensitive film may be formed in a dry film shape and is attached on the glass plate. The photosensitive film may be formed is such as manner that a photosensitive resin is coated using a spin cotter.

Next, the photosensitive film 401 is patterned based on a photolithograph method using a light exposing mask for thereby forming a photosensitive film pattern 402 as shown in FIG. 4B.

As shown in FIG. 4C, an insulation paste 403 is filled between the photosensitive film patterns 402.

As shown in FIG. 4*d,* the photosensitive film pattern 402 is removed, so that only the insulation paste 403 remains on the glass plate.

The above-described processes of FIGS. 4A through 4D are repeatedly performed, so that a barrier 404 having a height of 150~200 $\mu$m is formed as shown in FIG. 4E.

In the additive method for fabricating a barrier rid, it is possible to fabricate a barrier rib having a fine width and a large size area plate. However, in this method, if the height of the barrier rib exceeds 10□m, it takes long time to coat the pattern. In addition, since the insulation paste and photosensitive film are repeatedly patterned and removed for fabricating the barrier rib, a certain residual material of the insulation paste and photosensitive film may remain. In addition, the pattern may be deformed, and a crack may occur at the barrier rib.

Another conventional barrier rib fabrication method will be explained with reference to FIGS. 5A through 5D.

As shown in FIG. 5A, a barrier rib material layer 501 is formed on an upper surface of a glass plate 500 to have a thickness(for example, 150~200 $\mu$m). The barrier rib material layer is formed by coating an insulation paste or attaching a green tape.

As shown in FIG. 5B, a mold 503 having a groove 502 is prepared at a portion in which a barrier rib is formed on the barrier rib material layer 501.

Next, a certain pressure is applied and stamped, and then as shown in FIG. 5C, a barrier rib material is filled into the groove 502.

Thereafter, the mold 503 is removed for thereby forming a barrier rib 505 as shown in FIG. 5D.

However, in the above-described stamping method, in order to fill a barrier rib material into the mold, a certain pressure is required. In addition, a uniform pressure must be applied to the mold. If the pressure is not uniform, the barrier rib may not have the same height. In addition, as the barrier rib is highly defined, it is impossible to separate the mold and the barrier rib material layer after the barrier rib material is filled in the mold.

SUMMARY OF THE INVENTION

Accordingly, it is an object of the present invention to provide a backplate for a PDP(Plasma Display Panel) which is capable of providing a backplate of a PDP using an easily etched metallic material.

It is another object of the present invention to provide a structure of a PDP backplate which has an excellent heat transfer characteristic and heat radiating characteristic.

To achieve the above object, there is provided a backplate for a PDP according to a first embodiment of the present invention which includes a metallic plate having a certain thickness, a plurality of barrier ribs formed by etching the metallic plate, and an insulation formed on the wall surfaces of the barrier ribs and on an upper surface of the metallic plate.

To achieve the above object, there is provided a backplate for a PDP according to a second embodiment of the present invention which includes a metallic plate having a certain thickness, a plurality of barrier ribs arranged at a certain distance from each other on the metallic plate, an insulation layer formed on the wall surfaces of the barrier ribs and an upper surface of the metallic plate, a conductive layer formed on an upper surface of the insulation layer, a dielectric layer formed on a surface of the conductive layer, and a florescent layer formed on an upper surface of the dielectric layer.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A backplate and a fabrication method of the same according to the present invention will be explained with reference to the accompanying drawings.

Figure 1:
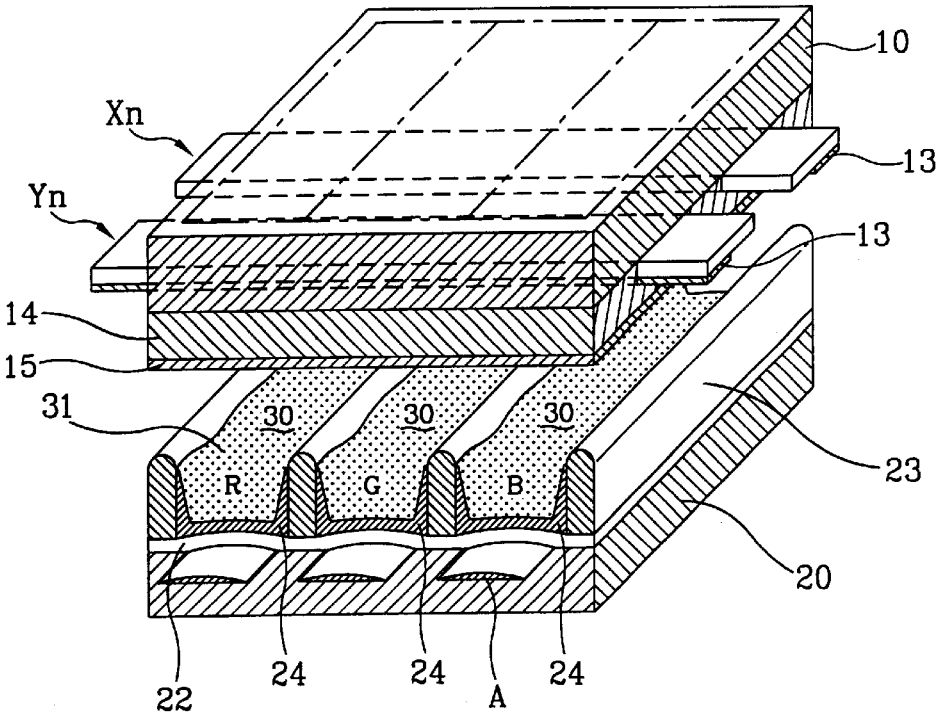
FIG. 1 CONVENTIONAL ART
FIG. 1 is a view illustrating the construction of a conventional PDP.
Figure 2A:
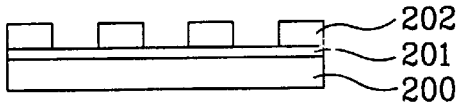
FIG. 2A CONVENTIONAL ART
FIGS. 2A through 2C are cross-sectional views illustrating a screen print method as one example of a conventional barrier rib structure fabrication method.
Figure 2B:
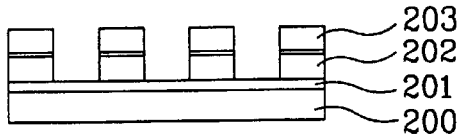
FIG. 2B CONVENTIONAL ART
Figure 2C:
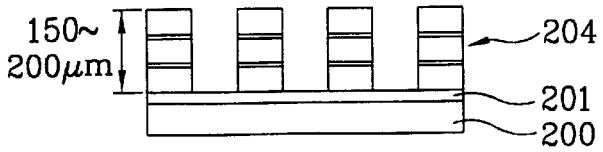
FIG. 2C CONVENTIONAL ART
Figure 3A:
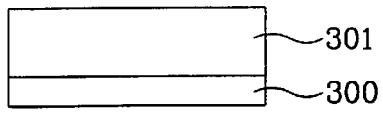
FIG. 3A CONVENTIONAL ART
FIGS. 3A through 3E are cross-sectional views illustrating a sand blasting method as another example of a conventional barrier rib structure fabrication method.
Figure 3B:
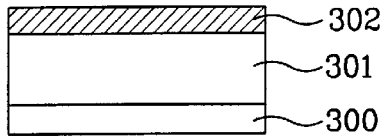
FIG. 3B CONVENTIONAL ART
Figure 3C:
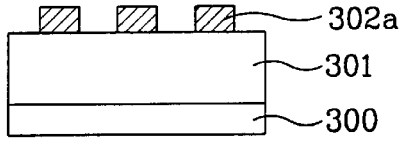
FIG. 3C CONVENTIONAL ART
Figure 3D:
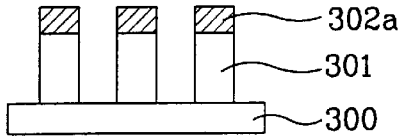
FIG. 3D CONVENTIONAL ART
Figure 3E:
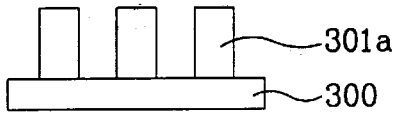
FIG. 3E CONVENTIONAL ART
Figure 4A:
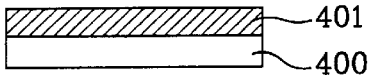
FIG. 4A CONVENTIONAL ART
FIGS. 4A through 4E are cross-sectional views illustrating an additive method as another example of a conventional barrier rib fabrication method.
Figure 4B:
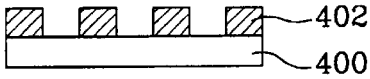
FIG. 4B CONVENTIONAL ART
Figure 4C:
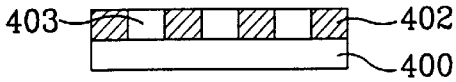
FIG. 4C CONVENTIONAL ART
Figure 4D:
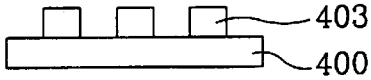
FIG. 4D CONVENTIONAL ART
Figure 4E:
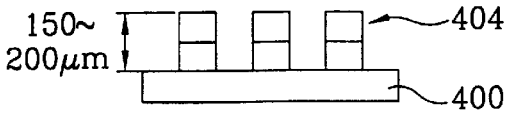
FIG. 4E CONVENTIONAL ART
Figure 5A:
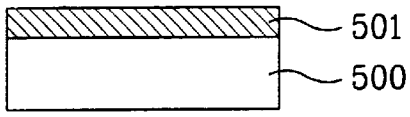
FIG. 5A CONVENTIONAL ART
FIGS. 5A through 5D are cross-sectional views illustrating a stamping method as another example of a conventional barrier rib structure fabrication method.
Figure 5B:
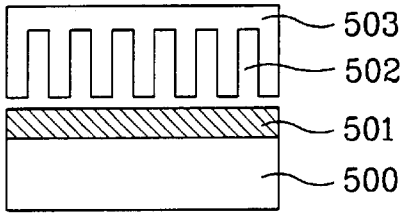
FIG. 5B CONVENTIONAL ART
Figure 5C:
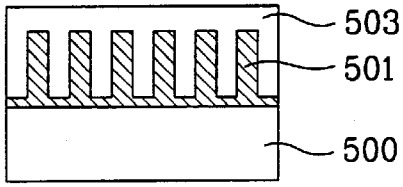
FIG. 5C CONVENTIONAL ART
Figure 5D:
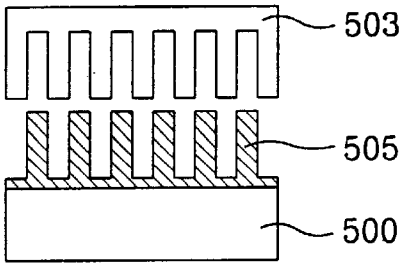
FIG. 5D CONVENTIONAL ART
Figure 6:
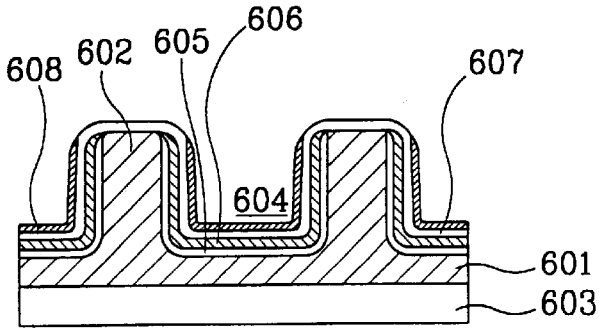
FIG. 6 is a cross-sectional view illustrating a backplate structure according to the present invention.

FIG. 6 is a cross-sectional view illustrating a back structure according to the present invention. A backplate 600 includes a metallic plate 601 having a certain thickness, and a plurality of metallic protrusions 602 which are formed on an upper surface of the metallic plate 601 at a regular distance. In addition, there is provided a thermal expansion coefficient sustaining layer 603 attached on a lower surface of the metallic plate 601. The metallic protrusions 602 become a barrier rib 602 for physically separating each discharge cell. In addition, the thermal expansion coefficient sustaining layer 603 maintains an approximate difference of a thermal expansion coefficient between the front and backplates of the PDP. Since the backplate of the present invention is formed of a metallic material, there is a difference in the thermal expansion coefficient with a glass used as a material of the front plate of the PDP. Therefore, when fabricating the PDP by bonding the metallic backplate and front plate, the backplate and the front plate may be separated from each other due to a different thermal expansion during the operation of the PDP. Therefore, the difference of the thermal expansion coefficients of the front plate and backplate is decreased by attaching a thermal expansion coefficient sustaining layer 603 formed of a glass or a glass-ceramic material, which has the same thermal expansion coefficient as that of the material of the front plate of the PDP or is similar to that of the material of the front plate of the PDP, on the lower surface of the metallic plate 601.

In addition, An insulation layer 605 is formed on a wall surface of the metallic protrusion 602, namely, the barrier 602 and on an upper surface of the metallic plate 601, namely, at an inner wall of the discharge cell 604. Each discharge cell 604 is electrically insulated by the insulation layer 605, so that each discharge cell 604 is independent to each other. In addition, an electrode layer 606 formed of a conductive material is formed on a surface of the insulation layer 605. The electrode layer 606 corresponds to an address electrode. A dielectric layer 607 is formed on an upper surface of the electrode layer 606. In addition, a fluorescent layer 608 is formed on a surface of the dielectric layer 607 of the discharge cell 604. In the backplate of the PDP according to the present invention, as a back base plate, a metallic plate is used without using a glass compared to the conventional art. In addition, as a barrier rib, the metallic protrusions are used for separating each discharge cell.

The structure of the present invention will be explained with reference to FIGS. 7A through 7F.

Figure 7A:
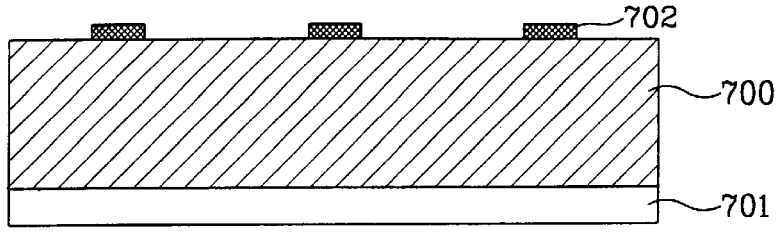
FIGS. 7A through 7F are cross-sectional views illustrating a backplate fabrication method according to the present invention.

First, as shown in FIG. 7A, a metallic plate 700 is prepared. A thermal expansion coefficient sustaining layer 701 is attached on a lower surface of the metallic plate 700. The thermal expansion coefficient sustaining layer 701 is preferably formed of a glass or a glass-ceramic material. The material of the metallic plate 700 is selected from the materials which do not have a large difference with the thermal expansion coefficient of a glass which is a material of the front plate and have an excellent etching characteristic. In the present invention, as a material of the metallic plate 700, a titanium Ti is used. In addition, the thickness of the metallic plate 700 is about 0.5 mm. Next, a photoresist film is formed on an upper surface of the metallic plate 700, and a resultant structure is patterned based on a photolithography method for thereby forming a photoresist pattern 702. At this time, the photoresist pattern formed at a portion in which the discharge cell is formed is removed for thereby exposing the upper surface of the metallic plate 700.

Figure 7B:
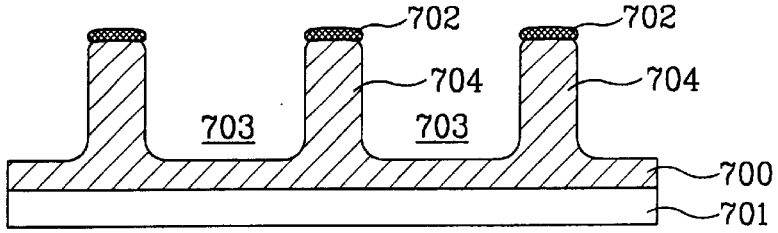

As shown in FIG. 7B, the exposed metallic plate 700 is etched using a HF solution by a certain depth for thereby forming a trench 703. The trench 703 becomes a discharge region, namely, a region in which the discharge cell is formed, so that a discharge occurs therein. The portion covered by the photoresist pattern 702 is not etched. The portion which is not etched becomes a metallic protrusion 704. The metallic protrusions 704 become barrier ribs for physically separating the discharge regions, namely, the discharge cells.

Figure 7C:
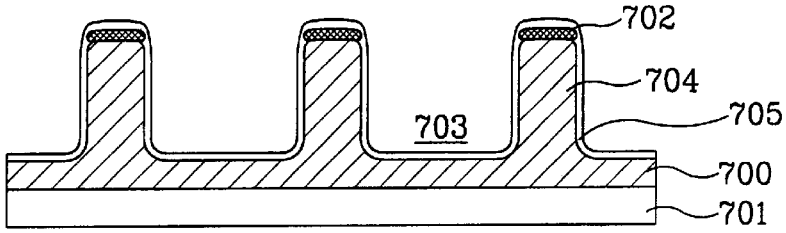

As shown in FIG. 7C, an insulation layer 705 having a certain thickness is formed on an upper surface of the entire structure of FIG. 7B using a spray method. The thickness of the insulation layer 705 is preferably 5 $\mu$m. The insulation layer 705 is formed by spraying a mixed solution manufactured by mixing a glass powder having a diameter of about 1~2 $\mu$m with an isopropylene alcohol. The insulation layer 705 electrically separate each discharge cell.

Figure 7D:
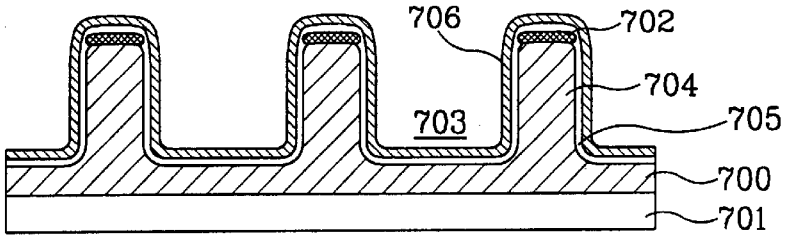

Next, as shown in FIG. 7D, a conductive material layer 706 is formed on an upper surface of the insulation layer 705. The conductive material layer 706 preferably has a thickness of about 5 $\mu$m. The conductive material layer 706 is formed by a spray method by mixing silver powder with a solution in which a MEK(Methylethylketon), a binding agent and a plasticizer are mixed or by a sputtering method.

Figure 7E:
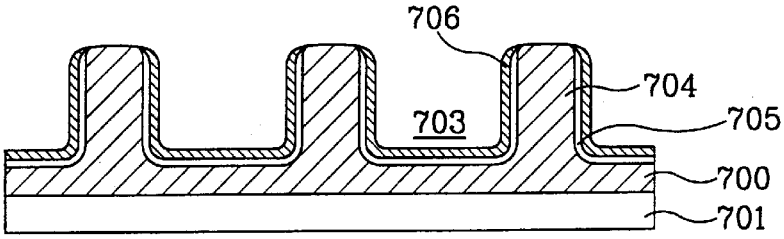

The conductive material layer is heat-treated for about 30 minutes at a temperature of about 400 C., so that burning organic components contained in the conductive material layer. At this time, a photoresist pattern 702 is formed on an upper surface of the barrier rib 704. A major component of the photoresist pattern 702 is an organic material. Therefore, the metallic protrusions 702, namely, the photoresist pattern 702 formed on the barrier rib 702 are burned and removed, so that the conductive material layer 706 formed on the upper surface of the photoresist pattern 702 is removed. Namely, as shown in FIG. 7E, as the photoresist pattern 702 and the conductive material layer 706 formed on the upper surface of the barrier ribs 704 are removed, the upper surfaces of the barrier ribs 704 are exposed. As a result, the conductive material layer is separated in both directions about each barrier rib 704 for thereby insulating the discharge cells, so that each discharge cell has an electrically separated structure. The conductive material layer which is formed to electrically insulating each discharge cell is called as an electrode layer 706*a*. Namely, the conductive material layer is partially removed by an organic burning process of the conductive material layer and by a lift-off method for thereby forming an electrode layer. Therefore, the process for patterning the electrode layer is omitted in the present invention, so that the process becomes simplified.

Figure 7F:
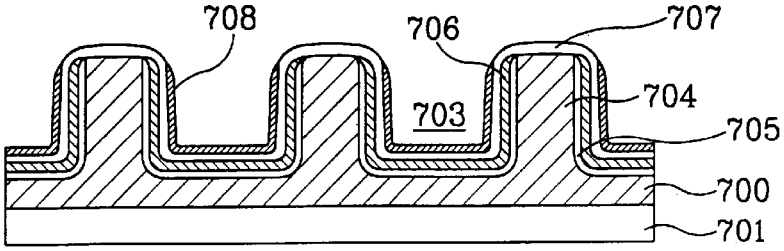

Next, as shown in FIG. 7F, a dielectric layer 807 is formed on a front surface of the structure as shown in FIG. 7E to have a thickness of about 12 $\mu$m by a spray method. The dielectric layer 807 is preferably formed of a glass material having a certain melting point higher by 50° C. compared to the material of the insulation layer 805. Next, a fluorescent layer 808 is formed on a surface of the dielectric layer 807, so that the fabrication of the backplate of the PDP according to the present invention is completed.

As described above, in the backplate structure and a fabrication method of the same according to the present invention, since the backplate is manufactured by an etching method using a metallic plate having an excellent etching characteristic, it is possible to implement a high definition and high aspect ratio of the PDP. In addition, since the metallic plate having a high heat conductivity operates as the back base plate of the PDP, a heat radiating effect is excellent, and a driving reliability of the PDP is enhanced during an operation of the PDP. In the present invention, it is possible to implement a low cost compared to the barrier rib manufacturing method which uses a conventional insulation paste.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A PDP (Plasma Display Panel) comprising:

a metallic backplate;

a front glass plate opposite to the metallic backplate;

barrier ribs which define a discharge region between the metallic backplate and front plate; and an insulating layer formed on the metallic backplate and the barrier ribs.

2. The PDP of claim 1, further comprising a thermal expansion coefficient sustaining layer provided on a lower surface of the metallic backplate.

3. The PDP of claim 2, wherein said thermal expansion coefficient sustaining layer is formed of a glass or a glass-ceramic material which has the same thermal expansion coefficient as the thermal expansion coefficient of the front glass plate or is similar to the thermal expansion coefficient of the front glass plate.

4. The PDP of claim 1, wherein said metallic backplate comprises titanium.

5. A PDP(Plasma Display Panel) backplate, comprising:

a metallic plate having a certain thickness;

a plurality of barrier ribs arranged at a certain distance from each other on the metallic plate;

an insulation layer formed on the wall surfaces of the barrier ribs and an upper surface of the metallic plate;

a conductive layer formed on an upper surface of the insulation layer;

a dielectric layer formed on a surface of the conductive layer; and a florescent layer formed on an upper surface of the dielectric layer.

6. The plate of claim 5, wherein a thermal expansion coefficient sustaining layer is provided on a lower surface of the metallic plate.

7. The plate of claim 6, wherein said thermal expansion coefficient sustaining layer is formed of a glass or a glass-ceramic material.

8. The plate of claim 5, wherein said metallic plate is a titanium plate.

9. The plate of claim 5, wherein said conductive layer is an address electrode of the PDP.

10. The PDP of claim 1, wherein the barrier ribs are formed by removing portions of a surface of the metallic backplate facing the front glass plate.

11. A plasma display panel, comprising:

a first substrate with sustain electrodes; and a second substrate facing the first substrate, wherein the second substrate comprises a metallic material with a flat portion and a plurality of barrier rib portions.

12. The plasma display panel of claim 11, further comprising an insulating layer formed on the second substrate including the barrier rib portions.

13. The plasma display panel of claim 12, further comprising a conductive layer on the insulating layer.

14. The plasma display panel of claim 13, further comprising a dielectric layer formed on the conductive layer and a fluorescent layer formed on the dielectric layer.

15. The plasma display panel of claim 11, wherein the insulating layer is formed on the second substrate excluding a top section of at least one of the barrier rib portions.

16. The plasma display panel of claim 15, further comprising address electrodes formed on the insulating layer.

17. The plasma display panel of claim 15, further comprising a dielectric layer formed on a top section of at least one of the barrier rib portions and a fluorescent layer formed on the second substrate between at least two of the barrier rib portions.

18. The plasma display panel of claim 11, further comprising a thermal expansion coefficient sustaining layer on the second substrate with a similar thermal expansion coefficient to the first substrate.

19. A plasma display panel, comprising:

a front substrate;

a rear substrate facing said front substrate to form a discharge space therebetween;

a plurality of barrier ribs located on the rear substrate within the discharge space, wherein the rear substrate and the plurality of barrier ribs are formed of a metallic material; and an insulating layer formed on the rear substrate and the barrier ribs.

20. The plasma display panel of claim 19, wherein barrier ribs are formed by etching the surface of the rear substrate facing the front substrate.

* * * * *